US005601624A

United States Patent [19]

Carey et al.

[11] Patent Number: 5,601,624

[45] Date of Patent: Feb. 11, 1997

[54] FUEL COMPOSITION WITH REACTION PRODUCT OF OXYGENATED AMINE, DICARBONYL LINKING AGENT, AND HYDROCARBYL(ENE) AMINE

[75] Inventors: James T. Carey, Medford, N.J.; John Hiebert, Levittown, Pa.; Andrew G. Horodysky, Cherry Hill, N.J.

[73] Assignee: Mobil Oil Corporation, Fairfax, Va.

[21] Appl. No.: 419,305

[22] Filed: Apr. 10, 1995

[51] Int. Cl.[6] ..... C10L 1/22; C10L 1/24; C10L 1/18

[52] U.S. Cl. ..... 44/347; 44/412; 44/418; 44/419; 44/433; 44/348

[58] Field of Search ..... 44/347, 412, 331, 44/415, 432, 433, 348, 346, 418, 419, 424, 425

[56] References Cited

U.S. PATENT DOCUMENTS

| | | | |
|---|---|---|---|
| 3,219,666 | 11/1965 | Norman et al. | 260/268 |
| 3,897,454 | 7/1975 | Hankins et al. | 252/51.5 A X |
| 4,098,585 | 7/1978 | Vartanian et al. | 44/63 |
| 4,661,274 | 4/1987 | Horodysky et al. | 252/47 |
| 4,711,736 | 12/1987 | Horodysky et al. | 252/51.5 A X |
| 4,744,798 | 5/1988 | Andress | 44/70 |
| 4,786,425 | 11/1988 | Horodysky et al. | 252/51.5 A X |
| 4,908,144 | 3/1990 | Davis et al. | 252/47.5 |
| 4,976,746 | 12/1990 | Denis et al. | 44/330 |
| 5,069,684 | 12/1991 | Blain et al. | 44/331 |
| 5,122,616 | 6/1992 | Malfer | 44/347 X |
| 5,160,649 | 11/1992 | Cardis et al. | 252/51.5 A X |
| 5,336,278 | 8/1994 | Adams et al. | 44/418 X |
| 5,362,411 | 11/1994 | Bergstra et al. | 252/51.5 A |
| 5,383,942 | 1/1995 | Su et al. | 44/418 X |
| 5,407,592 | 4/1995 | Cheng et al. | 44/343 X |
| 5,425,788 | 6/1995 | Garapon et al. | 44/347 X |
| 5,482,521 | 1/1996 | Avery et al. | 44/344 |

FOREIGN PATENT DOCUMENTS 1486144 9/1977 United Kingdom .

OTHER PUBLICATIONS

Grant & Hackh' Chemical Dictionary, McGraw–Hill Book Company, 5th ed., p. 559. (No month known.) 1987.

*Primary Examiner*—Douglas J. McGinty
*Attorney, Agent, or Firm*—M. D. Keen

[57] ABSTRACT

Oxygenated alkyl amines synthesized using carbonyl coupling reactions have combustion chamber deposit reducing properties and oxidative stability characteristics beneficial for dispersant/detergent applications in fuels and lubricants.

6 Claims, No Drawings

FUEL COMPOSITION WITH REACTION PRODUCT OF OXYGENATED AMINE, DICARBONYL LINKING AGENT, AND HYDROCARBYL(ENE) AMINE

FIELD OF THE INVENTION

This application is directed to fuel and lubricant additives and methods for preparing same. More specifically, it is directed to reaction products of an oxygenated amine with a carbonyl and an alkyl amine which combine to form a fuel or lubricant additive to prevent and control combustion chamber deposits.

BACKGROUND OF THE INVENTION

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption. Increased production of exhaust pollutants also occurs. For these reasons, fuel detergents or "deposit control" additives have been developed to minimize or prevent such deposits.

Deposit control additives, however, differ in their effectiveness for preventing or controlling deposits on various engine components. Effectiveness differences occur because engine components operate at different temperatures. Some deposit control additives are not sufficiently stable on the surface of certain engine components to perform their intended function. In this regard, deposits on intake valves are particularly difficult to control as intake valve operating temperatures can exceed 300 degrees C. At these temperatures, many fuel additives are too volatile to be effective, while others thermally decompose.

Therefore, what is needed is an effective deposit control additive which has improved thermal stability at normal engine intake valve operating temperatures which also possess sufficient molecular weight so as to be nonvolatile at these temperatures.

SUMMARY OF THE INVENTION

Reaction products of an oxygenated amine with a carbonyl compound or a carbonyl generating compound and an alkyl amine form an oxygenated alkyl amine to provide fuel and lubricant additives with novel characteristics. The oxygenated alkyl amine comprises a hydrocarbyl or hydrocarbylene oxygenated amine that can optionally contain a heteroatom selected from a member of the group consisting of sulfur, oxygen, or nitrogen. When additives containing these reaction products are incorporated into lubricants, they impart excellent lubricating properties as well as effective multifunctional dispersant, demulsifying, rust and corrosion inhibiting, antiwear, combustion chamber deposit reducing, friction reducing, and antioxidant qualities thereto.

These reaction products are obtained by reacting an oxygenated alkyl amine with a carbonyl compound or a carbonyl generating compound and alkyl amine under pressures varying from ambient to about 100 psi, or autogenous pressure conditions at temperatures varying from about ambient to about 250 degrees C. for about 1 to about 14 hours or for a time sufficient to obtain a desired additive product of reaction.

Additionally, this invention also concerns a composition or compositions of matter resultant from said reaction products. The composition comprises a lubricant composition having a major proportion of an oil of lubricating viscosity or a grease prepared therefrom or a liquid hydrocarbon, and a multifunctional dispersant, demulsifying, antiwear, friction reducing, combustion chamber deposit reducing, corrosion inhibiting, effective amount of the additive product of reaction.

It is therefore an object of this invention to provide for small concentrations of reaction products mentioned above for incorporation into fuels and lubricants such as lube oils and greases to impart similar properties and qualities thereto.

It is another object of this invention to provide for additive concentrations of an oxygenated alkylated amine derivative in lubes and fuels to minimize valve binding.

It is a further object of this invention to provide for additive concentrations of oxygenated alkyl amine derivatives which enhance water separation properties and dispersancy.

It is another further object of this invention to provide for additive concentrations of oxygenated alkyl amine derivatives which enhance fuel and lubricant properties by reducing hydrocarbon, carbon monoxide, and $NO_x$ emissions.

THE PREFERRED EMBODIMENTS

It has been found that compositions of highly oxygenated hydrocarbyl and hydrocarbylene substituted amines possess excellent high temperature decomposition properties along with resultant engine intake and combustion chamber deposit reducing tendencies. It has been found that these low viscosity fluids possess stickiness characteristics associated with minimal valve binding properties. Lubricant compositions containing these amines possess good oxidative stability properties. Additional cleanliness, antioxidant, friction modifying, antiwear, antifatigue, metal passivating, high temperature stabilizing properties, and reduced hydrocarbon/carbon monoxide/$NO_x$ emissions are likely. Both the oxygenate and hydrocarbyl/hydrocarbylene amine moieties are believed to provide the basis for the synergistic detergency/dispersancy and oxidative stability provided by these novel additives.

All of these beneficial properties are believed to be enhanced as a result of this novel internal synergism. This unique synergistic concept is believed to be applicable to similar structures containing single or multiple combinations of groups within the same molecule including: a) oxygenates and b)hydrocarbyl/hydrocarbylene succinimide groups coupled using a carbonyl linking group within the same molecule. Products containing these amines show good stability and compatibility when used in the presence of other commonly used additives in fuel and lubricant applications. When used as an additives in fuels, reduced pollution, as measured by hydrocarbon, carbon monoxide, and $NO_x$ emissions, is expected. Significant improvements in vehicle fuel economy benefits and longer engine service lifetime are also expected.

It has now been found that these structurally unique oxygenated hydrocarbyl and hydrocarbylene substituted amines, provide unexpected, but excellent high temperature decomposition characteristics consistent with excellent fuel and lubricant detergency/dispersancy. They also provide good lubricant oxidative stability.

These remarkable benefits are also expected for a variety of fuel compositions and for a variety of synthetic and mineral oil and vegetable oil based lubricants, or mixtures thereof Oxygenated alkyl amines were synthesized by reacting oxygenated amines with a carbonyl and an alkyl amine as shown in the equation below.

$$H_2N(CR_1R_2)_xO)_yR_3+R_4CR_5O+R_6R_7R_8N \rightarrow \text{Oxygenated Alkyl Amines}$$

where $R_1$ and $R_2$ are hydrogen or $C_1$-$C_{40}$ hydrocarbyl or hydrocarbylene or a mixture thereof, and may additionally contain oxygen, nitrogen, and sulfur; $R_3$ is hydrogen or $C_1$-$C_{40}$ hydrocarbyl or hydrocarbylene and may contain additional oxygen, nitrogen or sulfur; x=1–40, preferable 1–10; and y=1–200. Preferably $R_1$ and $R_2$ are hydrogen or $C_1$-$C_{10}$.

$R_4$ and $R_5$ are hydrogen or a linear, branched or cyclic $C_1$-$C_{200}$ hydrocarbyl or hydrocarbylene or is a mixture thereof; and may additionally contain sulfur, oxygen, or nitrogen. More preferably $R_4$ and $R_5$ are hydrogen or a $C_1$-$C_{30}$ linear, branched, or cyclic hydrocarbyl or hydrocarbylene or a mixture thereof, and may additionally contain oxygen, nitrogen, and sulfur, preferably additional oxygen.

$R_6$, $R_7$ and $R_8$ are hydrogen, or is a $C_1$ to $C_{300}$ linear, branched or cyclic hydrocarbyl or hydrocarbylene, or is a mixture thereof; and may additionally contain sulfur, oxygen, or nitrogen. One or more additional nitrogens is preferred.

Oxygenated amines that can be used include succinimides as exemplified by the structures below:

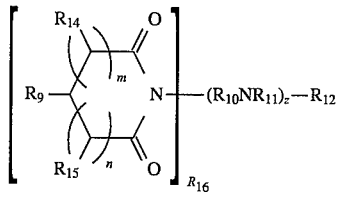

or

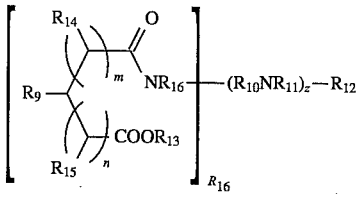

where $R_9$, $R_{11}$, $R_{12}$, $R_{13}$, $R_{14}$, $R_{15}$, and $R_{16}$ are hydrogen or branched or linear $C_1$-$C_{200}$ hydrocarbyl or hydrocarbylene or a mixture thereof; and can optionally contain additional sulfur, oxygen, and/or nitrogen; $R_{10}$ is $C_1$-$C_6$; $R_{12}$ is hydrogen; m and n=0–8; and z=1–20.

Carbonyl compounds, carbonyl precursory compounds, or carbonyl generating reagents that can be used have the formula below:

$$R_{17}COCR_{18}O$$

where $R_{17}$ and $R_{18}$ are hydrogen or $C_1$-$C_{30}$ linear, branched, or cyclic hydrocarbyl or carbylene, or a mixture thereof and can optionally contain additional sulfur, oxygen, and/or nitrogen.

Dicarbonyl or dicarbonyl generating compounds are the preferred linking agents. Of these, glyoxal is the preferred carbonyl linking agent. Other carbonyl linking agents include formaldehyde, paraformaldehyde, methylacetoacetate and benzaldehyde, methyl benzaldehyde, and 2-ethyl hexanal.

Amines that can be used include polyethylene amines and polyhydrocarbylene amines.

Polyethylene amines can be utilized as exemplified by: $H_2N(CH_2CH_2NH)_xCH_2CH_2NH_2$, where x=0–20, and more preferably x=0–4 .

Propylene amines too, can be used as exemplified by: $R_8NH(CH_2CH_2CH_2NH)_yCH_2CH_2CH_2NH_2$ where y=0–4 and $R_8$ is hydrogen or a $C_1$ to $C_{300}$ hydrocarbyl or hydrocarbylene, and can additionally contain sulfur, oxygen, or nitrogen.

Branched chain polyhydrocarbylene amines can be used as can related high carbon number and higher molecular weight amines.

No solvent is necessary but if a solvent is, for some reason desired, any suitable hydrocarbon solvent such as toluene, methanol, ethanol, xylenes, or hexane and mixtures thereof may be used.

Conditions for the above reactions may vary widely depending upon the specific reactants, the presence or absence of a solvent and the like. Any suitable set of reaction conditions known to the art may be used. Generally two to one stoichiometric quantities of reactants are used.

However, equimolar, more than molar or less than molar amounts may be used. The reaction temperature may vary from ambient to about 250° C. or reflux in a solvent, the pressure may vary from autogenous or ambient to about 100 psi.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleaginous materials such as hydrocarbyl lubricating media which may comprise liquid oils in the form of either a mineral oil or a synthetic oil, or in the form of a grease in which the aforementioned oils are employed as a support media.

In general, mineral oils, both paraffinic, naphthenic and mixtures thereof, employed as the lubricant, or grease vehicle, may be of any suitable lubricating viscosity range, as for example, from about 45 SUS at 100° F. to about 6,000 SUS at 100° F. and preferably, from about 50 to about 250 SUS at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes, and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers, and phenoxy phenylethers.

Fuels contemplated include liquid hydrocarbon and liquid oxygenated fuels such as alcohols and ethers. The additives can be blended in a concentration from about 0.1 to about 500 pounds of additive per 1,000 barrels of fuel. The liquid fuel can be a liquid hydrocarbon fuel or an oxygenated fuel or mixtures thereof ranging from a ratio of hydrocarbon fuel to oxygenated fuel from about 99:1 to about 1:99. Liquid hydrocarbon fuels include gasoline, fuel oils, diesel oils and alcohol fuels include methyl and ethyl alcohols and ethers such as TAME, ETBE, DIPE and MTBE.

Specifically, the fuel compositions contemplated include gasoline base stocks such as a mixture of hydrocarbons boiling in the gasoline boiling range which is within a range of about 90° F. to about 450° F. This base fuel may consist of straight chains or branched chains or paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point within the range of about 75° F. to about 135° F. and an end boiling point within the range of about 250° F. to about 750° F. It should be noted in this respect that the term distillate fuels is not intended to be restricted to straight-run distillate fractions. These distillate fuel oils can be straight-run distillate fuel oils catalytically (including hydrocracked) or thermally cracked distillate fuel oils etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing little or no hydrocarbon. Typical of such fuels are methanol, ethanol and mixtures of methanol and ethanol. The fuels which may be treated with the additive include gasohols which may be formed by mixing 90 to 95 volumes of gasoline with 5–10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and are not meant to be limitations.

Example 1

Reaction Product of a Polyetheramine, Gyloxal and Amine Containing Succinimide Approximately 0.1 mole of a commercial amine-containing succinimide, 60 g (0.1 mole) of M600 (Texaco "JEFFAMINE" polyetheramine), 173 g toluene and 79 g ethanol were charged to a 1 liter flask equipped with a thermometer, agitator and dropping funnel. The materials were mixed until homogeneous. Glyoxal (7.3 g, 0.05 mole, 40% in water) was added dropwise over a one hour period. The reaction mixture was stirred for 12 hours at room temperature. A light brown product (282 g) was obtained after filtration and removal of solvent and water under reduced pressure.

The high temperature decomposition profile of the product of Example 1 was evaluated by thermogravimetric analysis.

TABLE 1

Thermogravimetric Analysis

| Item | Residue at 450° C. (%) |
|---|---|
| Commercial polyisobutenyl succinimide (Comparative Example) | 8 |
| Example 1 | 5.5 |

The product of Example 1 was blended into gasoline and evaluated to determine the amount of fluidizer needed to reduce the additive's stickiness to a premium performance level.

TABLE 2

Stickiness Test

| Item | % Fluidizer |
|---|---|
| Commercial polyisobutenyl succinimide (Comparative Example) | 60 |
| Example 1 | 50 |

The product of Example 1 was blended into a lubricant and evaluated for oxidative stability in a hot tube test. This test subjects the lubricant composition to high temperatures under an oxidative environment. Oxidative instability results in residue formation which can be visually rated. The rating is from 1–10 with "10" indicating the poorest oxidative stability. A rating of "1" reflects the best cleanliness and stability.

TABLE 3

| Hot Tube Test | |
|---|---|
| Item | Rating at 295° C. |
| Base Oil | 7.5 |
| 4% of Example 1 in base oil | 4.5 |

As shown above, the products of this invention show an excellent high temperature decomposition profile, have excellent valve non-stickiness properties, and provide good lubricant oxidative stability as evidenced by thermogravimetric analysis, stickiness and hot tube results, even when compared to commercial polymeric succinimides.

INTERPRETATION OF TEST RESULTS

The use of additive concentrations of oxygenated amine derivatives in fuels will significantly reduce internal combustion chamber intake and combustion chamber deposits. They will also provide lubricant oxidative stability and dispersancy. These additives may also have the potential to benefit fuel and lubricant properties by reducing hydrocarbon, carbon monoxide, and $NO_x$ emissions, and by improving antiwear and fuel economy characteristics and by extending engine life.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A fuel composition comprising a liquid hydrocarbon or liquid oxygenated fuel or mixtures thereof and a minor multifunctional dispersant, antiwear, demulsifying, rust and corrosion inhibiting, rust inhibiting, deposit reducing, friction reducing, and antioxidant proportion of an oxygenated alkyl amine additive product of reaction prepared by reacting an oxygenated amine of the formula:

$$H_2N(CR_1R_2)_xO_yR_3$$

where $R_1$, $R_2$ and $R_3$ are hydrogen or $C_1$-$C_{40}$ hydrocarbyl or hydrocarbylene or a mixture thereof, and which can additionally contain a heteroatom selected from oxygen, nitrogen, or sulfur; x=1 to 40, and y=1 to 200, with (i) a dicarbonyl or dicarbonyl generating compound linking agent of the following structure:

$$R_{17}COCR_{18}O$$

where $R_{17}$ and $R_{18}$ are hydrogen or $C_1$-$C_{30}$ linear, branched, or cyclic hydrocarbyl or carbylene, or a mixture thereof and can optionally contain at least one heteroatom selected from a member of the group consisting of sulfur, oxygen, and nitrogen and (ii) a $C_1$ to $C_{300}$ hydrocarbyl or hydrocarbylene amine of the formula:

$$R_6R_7R_8N$$

where $R_6$, $R_7$ and $R_8$ are hydrogen or a $C_1$ to $C_{300}$ linear, branched or cyclic hydrocarbyl or hydrocarbylene, or is a mixture thereof and can additionally contain a heteroatom selected from sulfur, oxygen or nitrogen, wherein the reaction is carried out at temperatures varying from ambient to about 250° C., under pressures varying from ambient to about 100 psi for a time sufficient to produce an oxygenated alkylamine additive product.

2. The composition of claim 1 where the reactants are a succinimide, a polyetheramine, and glyoxal.

3. The composition of claim 1 wherein the fuel contains the oxygenated alkylamine additive in a concentration from about 0.1 to about 500 pounds of additive per 1,000 barrels of fuel.

4. The composition of claim 1 wherein the hydrocarbylene amine is polyethylene amine with the following structural formula:

$$H_2N(CH_2CH_2NH)_xCH_2CH_2NH_2, \text{ where } x=0\text{–}20.$$

5. The composition of claim 1 wherein the hydrocarbylene amine is polypropylene amine with the following structural formula:

$$R_8NH(CH_2CH_2CH_2NH)_yCH_2CH_2CH_2NH_2$$

where y=0–4 and $R_8$ is hydrogen or hydrocarbyl or hydrocarbylene, which additionally contains a heteroatom selected from a member of the group consisting of sulfur, oxygen or nitrogen.

6. The composition of claim 1 where the oxygenated amine is a compount having the following structure:

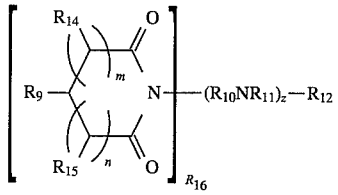

or

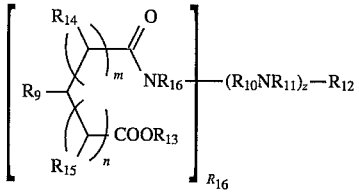

where $R_9$, $R_{11}$, $R_{12}$, $R_{13}$, $R_{14}$, $R_{15}$, and $R_{16}$ are hydrogen or branched or linear $C_1$-$C_{200}$ hydrocarbyl or hydrocarbylene or a mixture thereof which can optionally contain a heteroatom selected from a member of the group consisting of sulfur, oxygen, and nitrogen; $R_{10}$ is $C_1$-$C_6$; m and n=0–8; and z=1–20.

* * * * *